US005209336A

United States Patent [19]

Heltzen et al.

[11] Patent Number: 5,209,336

[45] Date of Patent: May 11, 1993

[54] NEWSPAPER VENDING MACHINE

[76] Inventors: John H. Heltzen, 3282 Orangewood Ave., Los Alamitos, Calif. 90720; Quentin W. White, 17749 Regency Cir., Bellflower, Calif. 90706

[21] Appl. No.: 836,246

[22] Filed: Feb. 18, 1992

[51] Int. Cl.[5] ..... G07F 11/14

[52] U.S. Cl. ..... 194/248; 221/103; 221/155; 221/241

[58] Field of Search ..... 194/248; 221/14, 103, 221/155, 230, 232, 241

[56] References Cited

U.S. PATENT DOCUMENTS 3,114,475 12/1963 Etes ..... 221/103
3,708,087 1/1973 Schonthal ..... 221/241 X
4,131,213 12/1978 Tamura et al. ..... 221/14
4,508,238 4/1985 Johnson et al. ..... 221/232 X

*Primary Examiner*—F. J. Bartuska
*Attorney, Agent, or Firm*—Francis X. LoJacono

[57] ABSTRACT

The present invention relates to a coin-operated newspaper vending machine that is designed to prevent direct access to the newspaper-storage compartment by means of a door that includes a newspaper-display compartment. A multiplicity of stack newspapers are stored within the storage compartment defined in the vending-machine housing and are supported on a floating shelf that aligns the uppermost newspaper with a newspaper-dispensing device that includes a paper dispensing carriage on which is mounted a feeder plate aligned to engage and dispense the uppermost-positioned newspaper through a discharge chute formed in the door of the vending machine. The newspaper-display compartment is adapted to dispense the displayed newspaper stored therein after all of the newspapers stored in the storage compartment have been dispensed.

13 Claims, 8 Drawing Sheets

FIG. 1
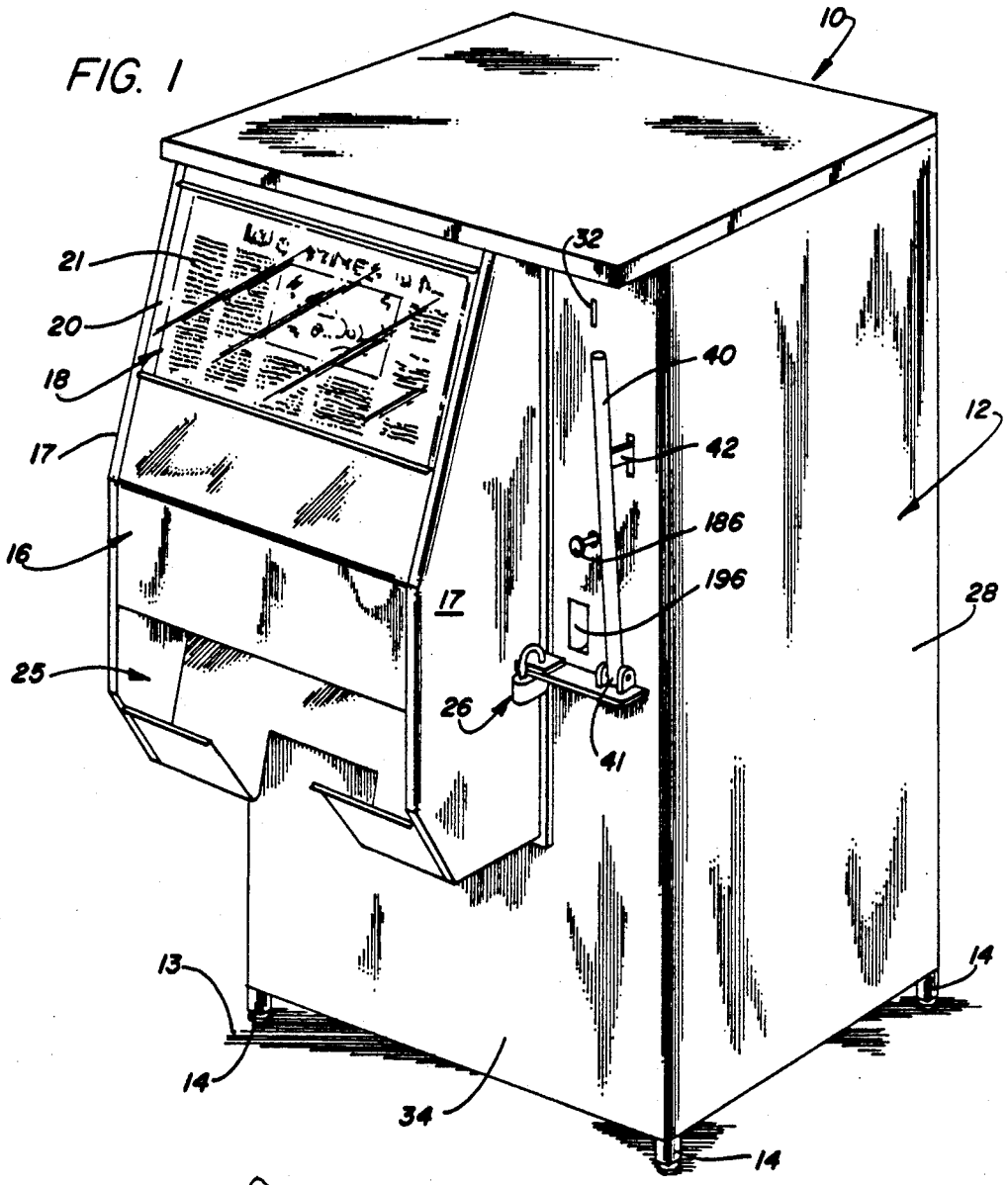
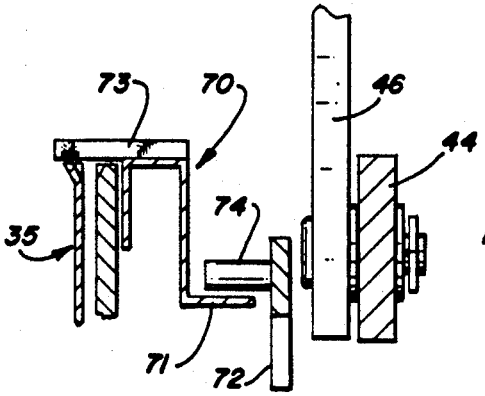
FIG. 14

10
20
18
19
21
80
28
22
17
84
134
16a
23
16
12
24
16b
25
14
14
13

NEWSPAPER VENDING MACHINE

BACKGROUND OF THE INVENTION

1. Field of the Invention

The present invention relates generally to newspaper vending machines and more particularly to a coin-operated newspaper vending machine that is designed to prevent direct access to the newspaper storage compartment. Each newspaper stored within the storage compartment is arranged to be individually dispensed without the need to open the entire compartment during the operation of the dispensing apparatus. The structural configuration of the apparatus prevents theft of not only the stored papers but also the coins that have been deposited in the vending machine.

2. Description of the Prior Art

As is well known in the art, various problems and difficulties are encountered in providing a coin-operated newspaper vending machine with suitable means and configurations that would prevent the removal of more than one newspaper during a single operation and the possibility of theft of the internally positioned money container.

Many types of newspaper vending machines are presently used in great numbers and others have been tried and suggested. However, these known vending machines have not yet solved the most prevalent problem of preventing papers from being stolen from their storage areas. The most common type of newspaper vending machine is still the one that employs a simple box-like structure that includes a front access door which is normally locked to prevent access to the stored newspapers. These doors are commonly releasably unlocked by various types of coin-operated devices. That is, the locked door is opened by placing the proper amount of coins in a coin-operated device that allows the door to be unlocked and opened, thus exposing all of the stored newspapers. Many papers are lost due to the temptation to take more than one paper at a time. It has become very lucrative to take all of the accessible newspapers by those unscrupulous individuals who make a practice of removing all of the newspapers for resale. This practice has become so common that the larger newspaper companies lose as much as $25,000 to $30,000 dollars a month in sales from vending machines. Since the prices of newspapers have risen considerably more people have become very adept at finding ways to extract newspapers stored in almost all of the commonly used newspaper vending machines.

Some manufactures of newspaper vending machines have tried to provide a means to dispense papers one at a time without exposing the remaining papers. However, these particular vending machines have not been too successful because they have various limitations that restrict their use. One limitation is that the structure of the known single-paper dispensing apparatus can only be loaded one paper at a time which slows down the delivery routes and thus adds to the cost of operation.

OBJECTS AND ADVANTAGES OF THE INVENTION

It is an important object of the present invention to provide a theft-proof newspaper vending machine that is constructed in such a manner that the storage area or compartment for the newspapers is locked so as to prevent access to compartment by anyone other than the person or persons who own, operate and/or service the vending machine. The housing of the present invention is constructed so that it has a unique internal configuration, whereby the operational components, as well as the stored newspapers, are protected within the interior of the housing of the vending machine. The housing includes a door structure that is used not only to provide a means to restrict access to the interior of the machine but also includes a display compartment. The display compartment of the door is constructed to display the daily newspaper and also allow the displayed newspaper to be discharged when all of the stored newspapers have been removed from a floating newspaper-support shelf in the paper storage compartment.

It is another object of the invention to provide a coin operated newspaper vending machine that includes a self-adjusting floating support shelf that supports a multiplicity of newspapers and automatically positions each successive newspaper in alignment with a feeder plate. As the dispensing handle is operated, the feeder plate engages the uppermost mounted newspaper and moves it forward to a discharge chute which is formed in the display door. The handle is attached to a dispensing lever which is normally locked in a fixed position by a releasable locking device that can only be operated when the proper amount of coins are inserted in the coin-operated mechanism. Accordingly, only one newspaper can be dispensed for each operation of the coin-operated mechanism. At no time is the internal structure of the vending machine exposed. The floating support shelf is counter-balanced so as to automatically adjust itself vertically as each newspaper is removed from the shelf. The remaining shelved newspapers are subsequently repositioned for proper alignment and engagement with the feeder plate each time the uppermost paper is removed. When a newspaper is to be dispensed a feeder plate is moved longitudinally as the dispensing lever is pulled forward, at which time a feeder carriage moves the feeder plate to engage the uppermost newspaper and pushes the paper into the discharge chute of the locked door. After the last shelved newspaper is discharged, the display newspaper mounted in the door is adapted to be released from the display compartment. The removal of the display newspaper indicates that there are no longer any newspapers left in the vending machine.

The characteristics and advantages of the invention are further sufficiently referred to in connection with the accompanying drawings, which represent one embodiment. After considering this example, skilled persons will understand that variations may be made without departing from the principles disclosed; and we contemplate the employment of any structures, arrangements or modes of operation that are properly within the scope of the appended claims.

BRIEF DESCRIPTION OF THE DRAWING FIGURES

With the above and related objects in view, the invention consists in the details of construction and combination of parts, as will be more fully understood from the following description, when read in conjunction with the accompanying drawings and numbered parts, in which:

FIG. 1 is a perspective view of the present invention which is defined as a newspaper vending machine;

FIG. 14 is a cross-sectional view taken substantially along line 14—14 of FIG. 3.

DETAILED DESCRIPTION OF THE INVENTION

Figure 2:
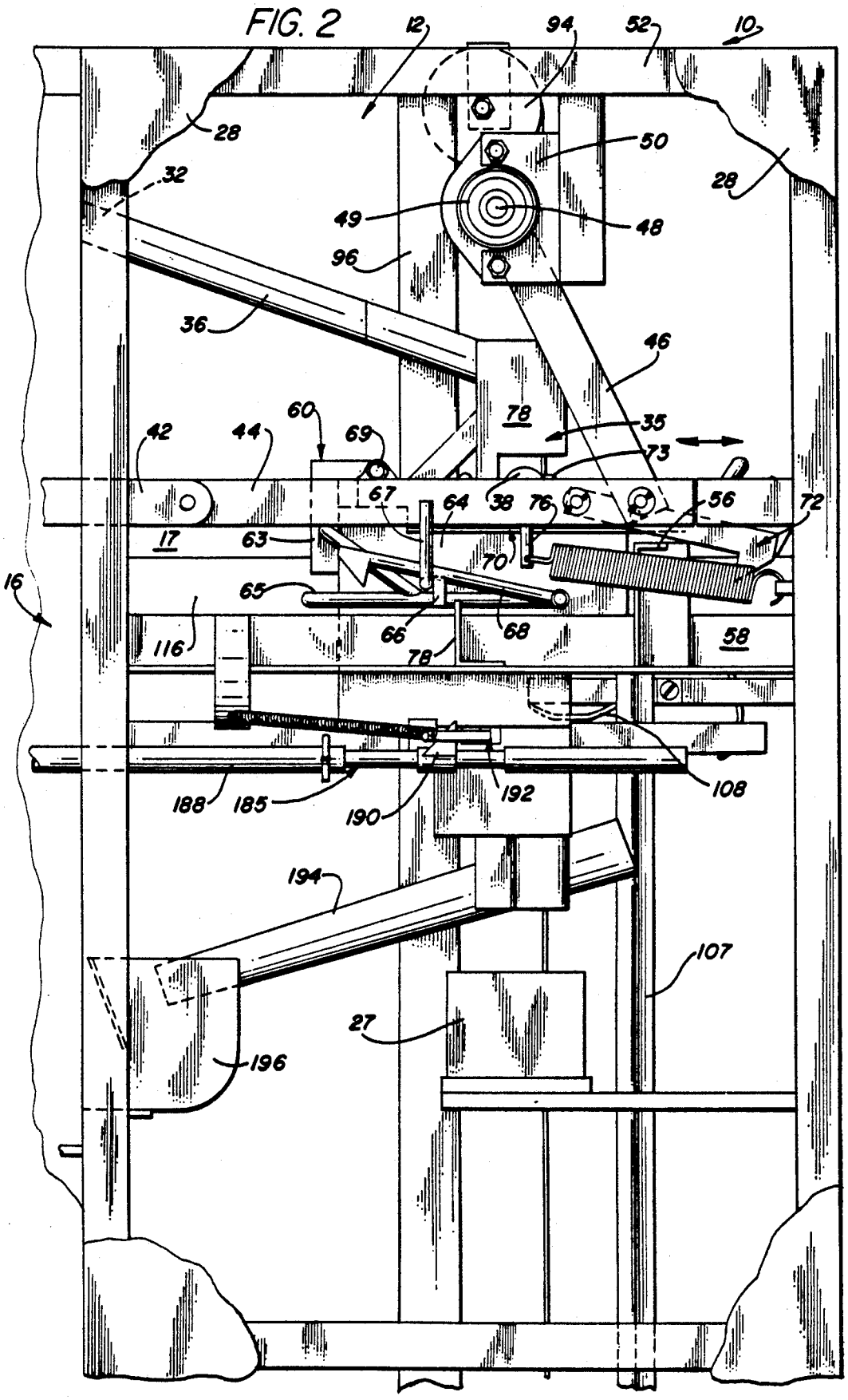
FIG. 2 is an enlarged partial right-side-elevational view with the side wall of the housing being removed to illustrate the paper-release mechanism in an inactive position.

Referring more particularly to FIG. 1, there is illustrated in the perspective view of the preferred embodiment of the present invention a newspaper vending machine, generally indicated at 10. Vending machine 10 comprises a housing 12 having a general overall rectangular configuration which is adapted to be fixedly mounted to the ground 13 by means of mounting legs 14. These mounting legs are arranged to be secured by suitable fastening means from within the closed housing 12. Access to the interior of vending machine 10 is provided by a door, generally designated at 16, which is normally locked so as to control the access to a newspaper-storage compartment 17, which will hereinafter be described in more detail with respect to several referenced views. Door 16 further defines a newspaper display cabinet or compartment 18 that includes a glass panel 20 through which a copy of a newspaper 21 is displayed for a given day. (See FIG. 1.) The display compartment is also provided with a hinge-plate support 22 to release stored newspaper 21 so that it can be readily discharged when there are no remaining newspapers stored in the newspaper-storage compartment. Door 16 includes a pair of discharge chutes 23 and 24. Chute 23 communicates at its upper end with display compartment 18 and terminates at its lower end in trough 25. Chute 23 is defined by the front wall of door 16 and an intermediate partition 16*a*. Chute 24 is arranged to communicate with newspaper-storage compartment 17 and is defined by the intermediate partition 16*a* and an inner panel 16*b*. The opposite open end of chute 24 also terminates in a paper receiving trough 25.

A suitable locking means, such as indicated at 26, can be provided, whereby access to the interior of housing 12 is controlled, and not only to the stored newspapers but also to a coin box such as indicated at 27.

Referring now to FIG. 2, there is shown an enlarged view of the upper portion of the vending machine, wherein the side wall 28 is broken away to show various operating components of the apparatus. In order to operate the vending machine so as to sequentially discharge a newspaper, a given amount of coins must first be inserted in the coin receiving opening 32 located in the front wall 34 of the housing. The coin or coins enter a coin-operated means, indicated generally at 35 by means of coin-receiving trough 36. It should be noted that any suitable automatic coin-operated means can be employed. As an example, a coin 38 is illustrated in an operating position in both FIGS. 2 and 4. As seen in FIG. 1 a paper-dispensing handle 40 is pivotally mounted to the front wall 34 at its lower end 41. The upper section of handle 40 is provided with a connecting ear 42 which is operably attached of an actuating means defined by an attached arm member 44 that extends horizontally reward so as to be pivotally connected to upright crank arm 46 that forms part of an engagement means 47, as will be hereinafter described. Crank arm 46 extends upwardly and is fixedly secured to a rotatably mounted shaft 48, whereby shaft 48 is rotatable in a back-and-forth manner as handle 40 is operated by being pulled and released. Shaft 48 is supported in a pair of oppositely positioned bearings 49 that are mounted to respective support plates 50 which are secured to each side of housing frame structure 52.

Figure 3:
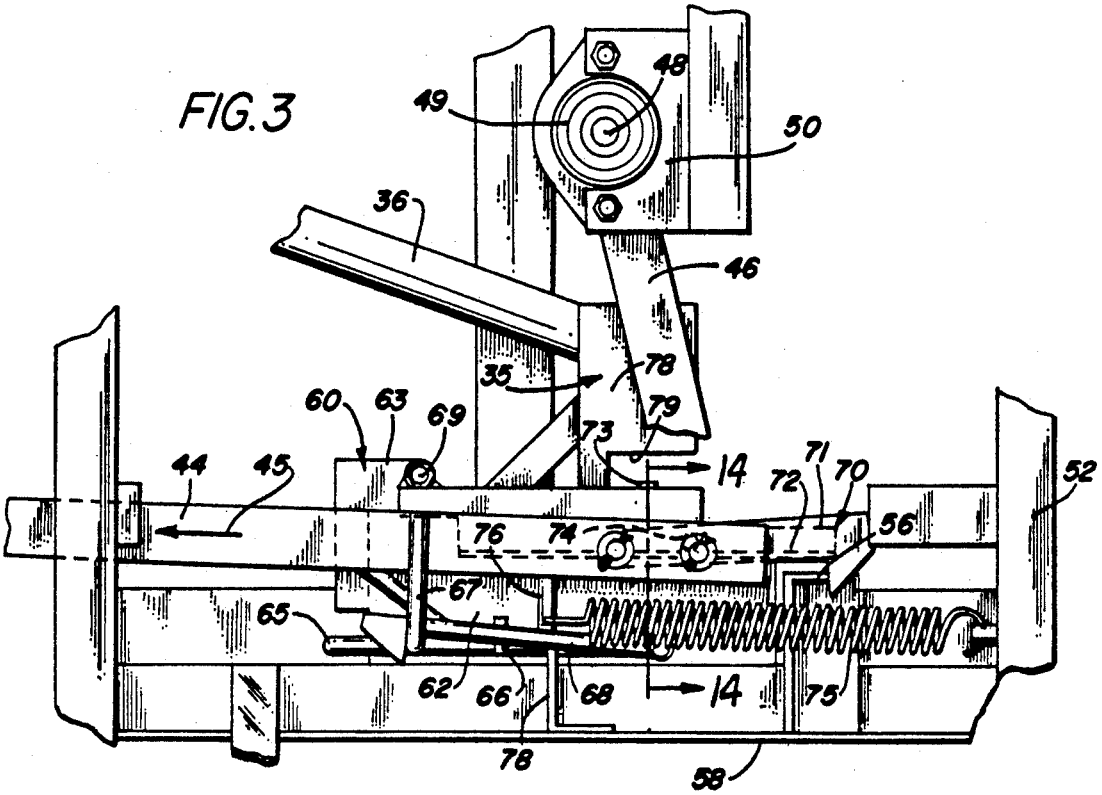
FIG. 3 is an enlarged side-elevational view of the paper release mechanism in a locked position when the paper dispensing handle is operated without coins being positioned in the coin receiving apparatus.
Figure 4:
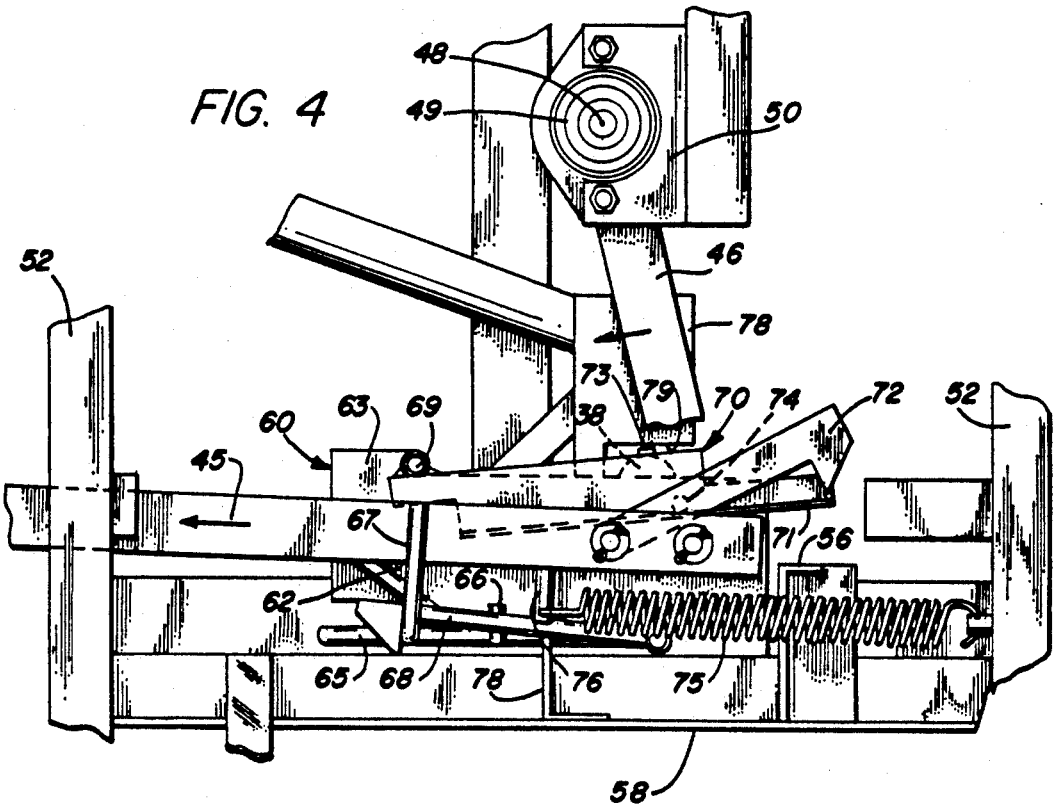
FIG. 4 is a right-side-elevational view similar to that shown in FIG. 3 wherein the locking latch of the paper-release mechanism is moved to a released position when a coin is inserted in the coin receiving apparatus.
Figure 5:
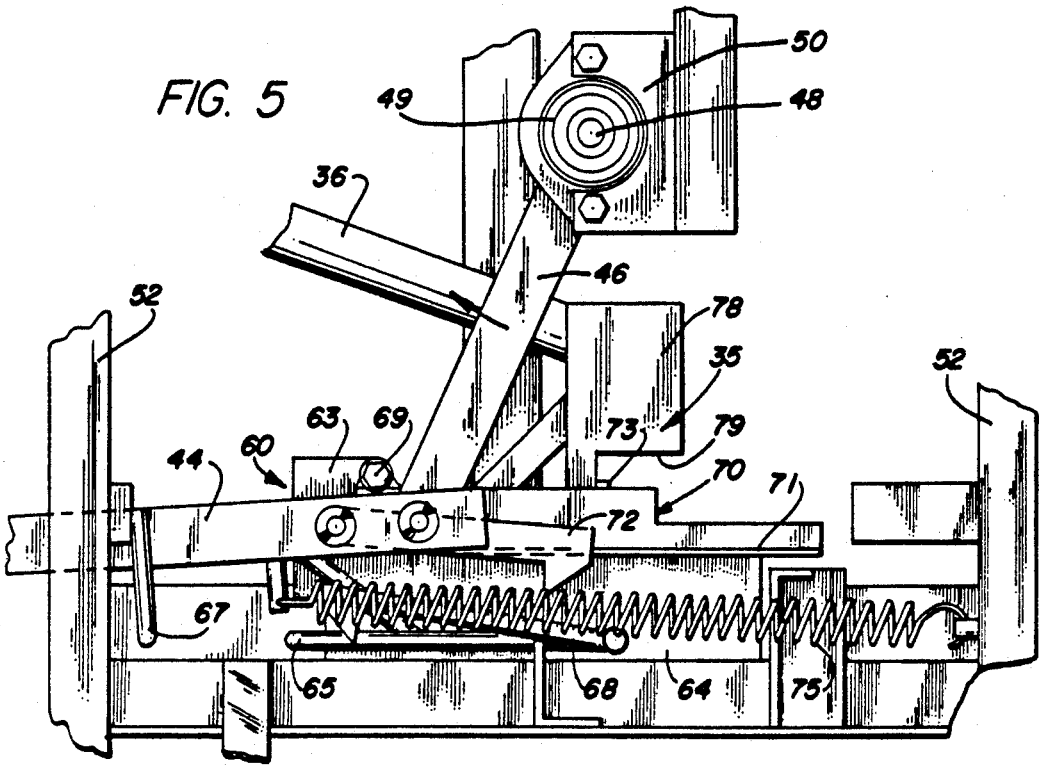
FIG. 5 is a similar side-elevational view of the paper release mechanism moved to a fully extended position, whereby a newspaper is discharged into the paper receiving trough.

As handle 40 is pulled outwardly a coin-operated means 35 comprising an actuating carriage means 60 is adapted to be moved outwardly from a carriage-plate support frame 62, as indicated in FIGS. 3, 4 and 5. Carriage means 60 comprises a carriage plate 63 that is slidably mounted in a carriage-plate support frame 62 so as to allow carriage plate 63 to move back and forth as handle 40 is operated. Carriage plate 63 includes a horizontal arm member 65 which is fixedly attached to the lower portion of carriage frame 63. A return lug member 66 is mounted to arm member 65 just in front of a floating latch member 68 which is pivotally attached to the rear of arm member 65. Latch member 68 rests on latch holder 67 which is affixed to arm 44 and, as long as latch member 68 is hooked over latch holder 67, carriage plate 63 will move forwardly and rearwardly with arm member 44. Also pivotally attached to carriage plate 63, at 69, is a coin-activated releasing means, indicated generally at 70, which is defined by lift-plate member 71, as best seen in FIGS. 5 and 14. Lift plate member 71 operates a second floating latch member 72, which is pivotally attached to lever arm 44. An extended pin 74 is fixedly attached to latch member 72 and extends inwardly so as to be engaged by the flat member of lift plate 71. Lift plate 71 is also provided with a coin-engaging bar member 73 that rests on the upper edge of carriage-plate support frame 62 in a position to engage an inserted coin 38, as shown in FIG. 2.

When handle 40 is operated, as illustrated in FIG. 3, without a proper coin or coins being inserted in coin-operated means 35, lever arm member 44 is restricted in its forward movement. Carriage plate 63 is adapted to be latched to arm member 44 by latch member 68 and will move with arm 44 until latch member 68 is released from latch keeper 67. However, arm member 44 is prevented from further forward movement, as indicated by arrow 45, due to the engagement of floating latch 72 with stop member 56 which is secured to fixed frame member 58. Since there is no coin in position to engage bar 73, floating latch member 72 can not be raised by plate 71 so as to clear stop member 56.

It should be noted that whenever handle 40 is pulled forward and then released it will return to an inactive mode, as seen in FIG. 2, by means of spring 75 which is attached between frame 52 and depending lug member 76 affixed to actuating-lever arm 44.

Referring now to FIG. 4, there is shown the coin 38 inserted in the coin-operated means 35, wherein coin 38 is in position to extend above the opening 79 of the coin-receiving member 78. When handle 40 is pulled outwardly, coin-engaging bar 73 will engage coin 38 and ride up and over the edge of coin 38. In doing so, plate 71 of actuating member 70 is raised, thereby engaging pin 74 and lifting latch member 72 high enough to clear stop member 56, thus allowing lever arm 44 and carriage plate 63 to move forwardly in the direction of arrow 45. As arm 44 and carriage plate 63 move in the forward direction latch member 68 is raised by engaging a cam-bar member 78 which is positioned under latch 68. (See FIG. 5.)

As soon as latch 68 clears latch keeper 67, carriage plate 63 is allowed to be extended to its most forward position, further freeing lever arm 44 so as to extend outwardly as handle 40 is pulled to its outermost position. The full extension of lever arm 44 causes crank crank arm 46 to rotate to its forward position, at which time a newspaper is automatically dispensed from the vending machine. A detailed description of the dispensing means will be hereinafter described. After the newspaper is discharged into trough 25, handle 40 is released and biased back to an inoperative locked mode by spring 75. (See FIG. 2.) The vending machine is now ready to dispense another newspaper when the proper coin or coins are again inserted into the coin-operated means.

As arm 44 moves in a rearward direction, latch keeper 67 will again engage latch 68, and the arm continues moving rearwardly to engage return lug member 66 which causes carriage-plate member 63 to slide rearwardly so that the coin-engaging bar is in a neutral position.

Referring now to FIGS. 6 through 9, there is illustrated a plurality of newspapers 80 stacked one on top of the other on a floating support means, generally indicated at 82, and defined by a floating tray or shelf 84 that is automatically adjusted by a paper positioning means, indicated generally by numeral 85. Paper-positioning means 86 automatically positions the uppermost or top newspaper 81 so as to be received by a paper-dispensing means, generally indicated at 86. Each time the top newspaper is dispensed the succeeding newspaper is automatically positioned to be engaged by the paper-dispensing means 86.

Figure 8:
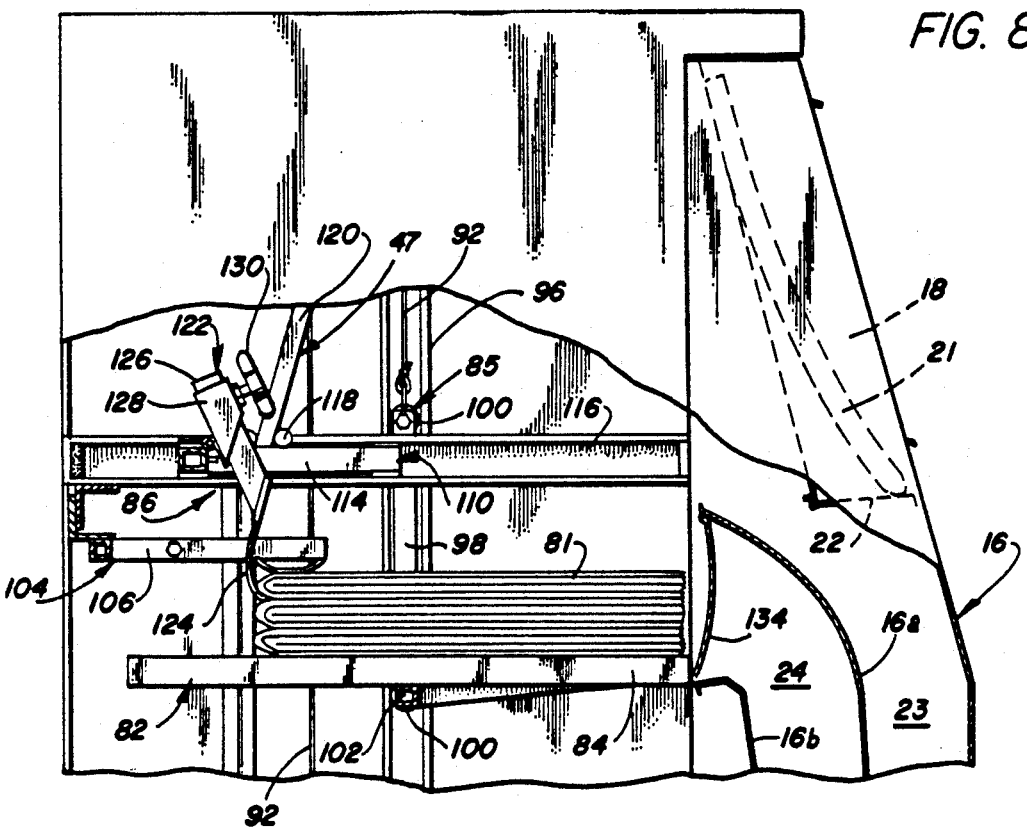
FIG. 8 is a cross-sectional view taken substantially along line 8—8 with the top newspaper in position on the floating shelf being engaged by the feeder plate.
Figure 9:
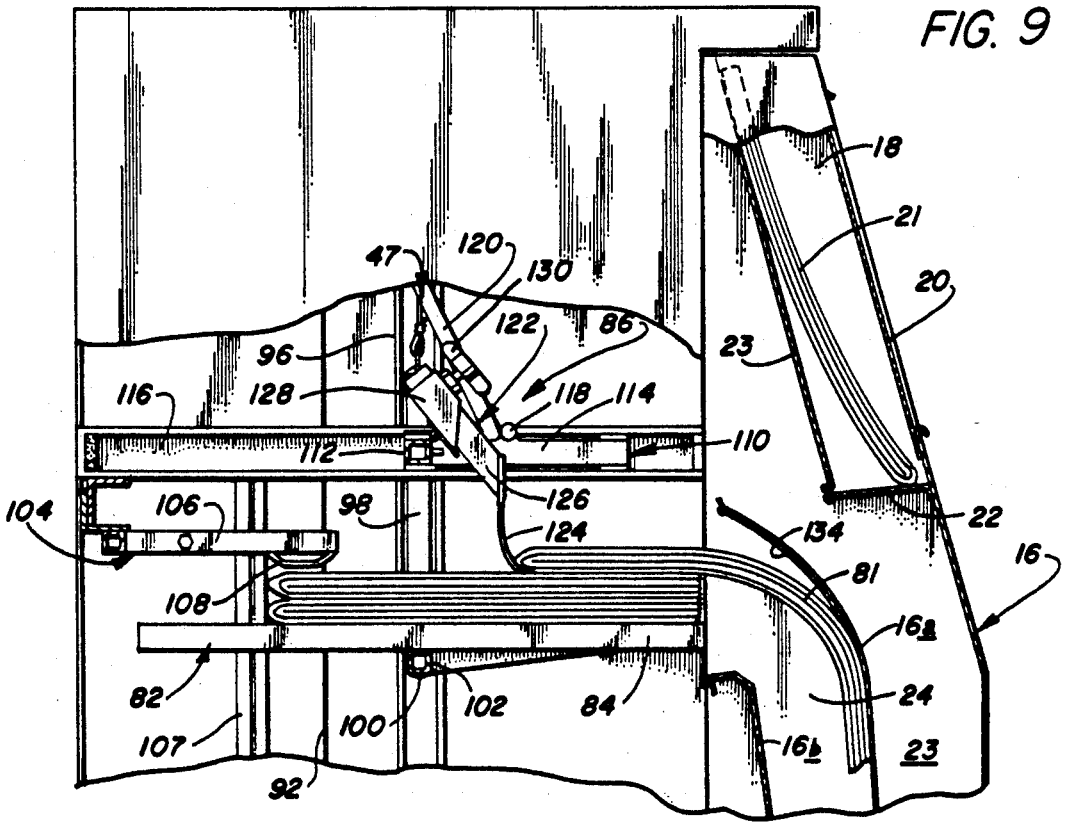
FIG. 9 is a cross-sectional view similar to that of FIG. 8 showing the top newspaper being pushed into the discharge chute.

Shelf 84 is attached to the paper-positioning means 85 which comprises counter-balancing means that are located on each side of shelf 84, each counter-balancing means being defined by a vertically positioned balancing spring 88 which is attached at one end to the lower portion of main frame 52 by member 90 and at its upper end to a cable 92. Cable 92 extends upwardly to pulley 94, which is mounted at the top of main frame 52, and downwardly within a vertical track member 96, as is clearly shown in FIG. 7. The distal end of cable 92 is connected to a guide bar 98 which is slidably mounted within track member 96. Each end of guide bar 98 is provided with a roller 100 that rides within track 96. A support strut member 102 is transversely mounted to and between each oppositely disposed guide bar 98 and is arranged to be affixed to shelf 84, whereby shelf 84 will be vertically moved up or down according to the weight of the papers 80. Thus, it can be understood that, when a multiplicity of newspapers are mounted on shelf 84, the weight will overcome the retracting force of the combined springs 88 and allow the shelf and the supported papers to be lowered within the compartment 17. However, as each paper is removed from the stack of papers 80, shelf 84 will rise upwardly, thus forcing the top newspaper 81 to engage paper-alignment means 104. The alignment means comprises a pair of fixed spaced-apart leg members 106 that are fixedly secured to main frame 52 and to a pair of vertical strut members 107 that pass through holes formed in shelf 84. Each leg member 106 includes a foot-pad member 108 mounted at their respective free ends to stop or limit the upward movement of the shelved newspapers 80. As the upper or top paper 81 is removed from the stack, the succeeding paper will engage the pair of oppositely disposed foot pads 108, as indicated in FIGS. 6, 8 and 9.

The paper-dispensing means 86 is defined by a paper-dispensing carriage 110 that comprises a transverse rear frame member 112 which is formed with oppositely positioned carriage-guide members 114 that are adapted to be slidably received in respective horizontally arranged rails 116. Each guide member 114 includes a coupling bracket defined by a pair of shoulder pins 118 which are formed to receive part of engagement means 47 defined by a pair of corresponding and depending arm members 120 positioned to be engaged therebetween. Each reciprocal arm member 120 is fixedly mounted adjacent the respective opposite ends of the horizontally positioned shaft 48 that is reciprocally journaled in bearings 49. Thus, as crank arm 46 is moved in a back-and-forth movement with that of the reciprocating movement of handle 40, as heretofore described, dispensing carriage 110 will also move back and forth within rails 116.

Attached to the rear transverse frame member 112 is a newspaper-feeder means, designated at 122, that is adapted to engage, push and directly feed the top-positioned newspaper 81 forward into dispensing chute 24. However, it should be noted that each daily and Sunday newspaper varies in thickness relative to the number of pages and/or inserts in an edition on a particular day. This requires that feeder means 122 be adjusted to correspond to the specific thicknesses of the newspapers for a given day so that it can properly engage the rear edge of each paper, as illustrated in FIG. 8. Accordingly, feeder means 122 comprises a feeder plate or scope 124 that is secured to an extension arm 126 which is adjustably mounted to a hinged sleeve 128 by a suitable set screw, as indicated by knob 130. Sleeve 128 is attached to transverse rear frame member 112 by hinge member 132. When all of the newspapers are placed on shelf 84 at the beginning of the day, feeder plate 124 is then positioned to engage top paper 81 as illustrated in FIG. 8 and, when moved forward, feeder plate 124 will move paper 81 only until it drops through chute 24 and freely falls into trough 25 of door 16. A protective hinged panel 134 is located at the mouth of chute 24 so as to prevent access to the stored papers. The succeeding stacked newspaper now is raised up against foot-pad member 109 of paper-alignment means 104. As handle 40 is released, feeder plate 124 slides freely over the top newspaper and the plate returns with carriage 110 to its original rest position, wherein feeder plate will realign itself at the rear of the next newspaper in line.

Figure 6:
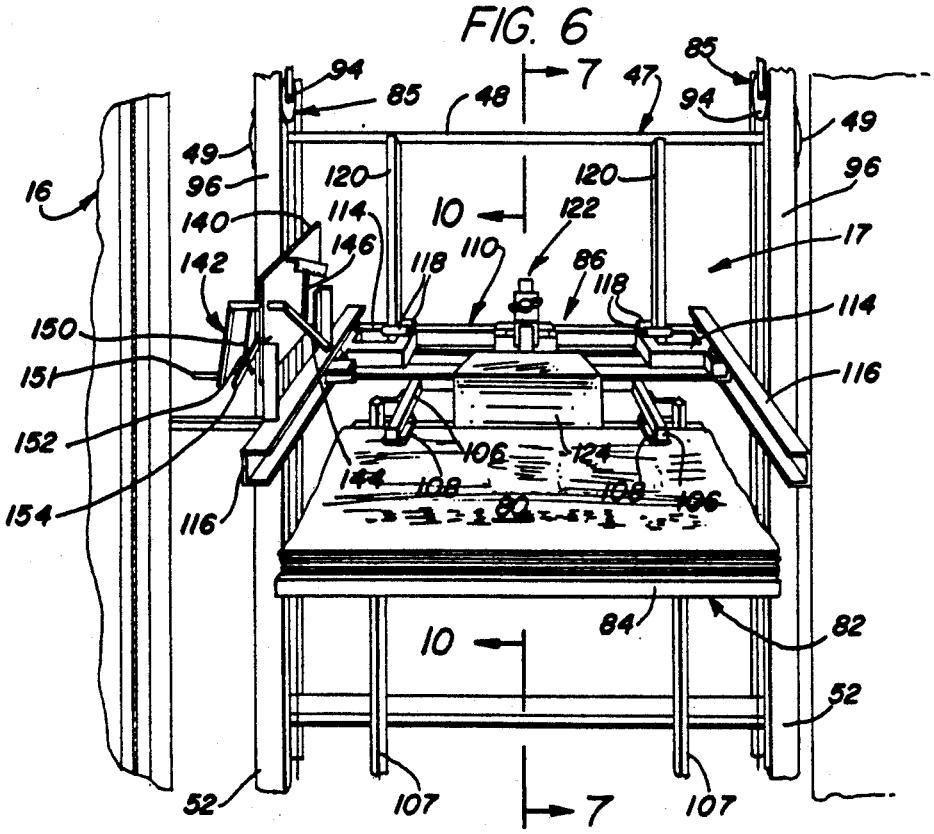
FIG. 6 is a pictorial view of the door in an open position showing the internal structure of the newspaper-storage compartment with several newspapers supported on the floating shelf.
Figure 7:
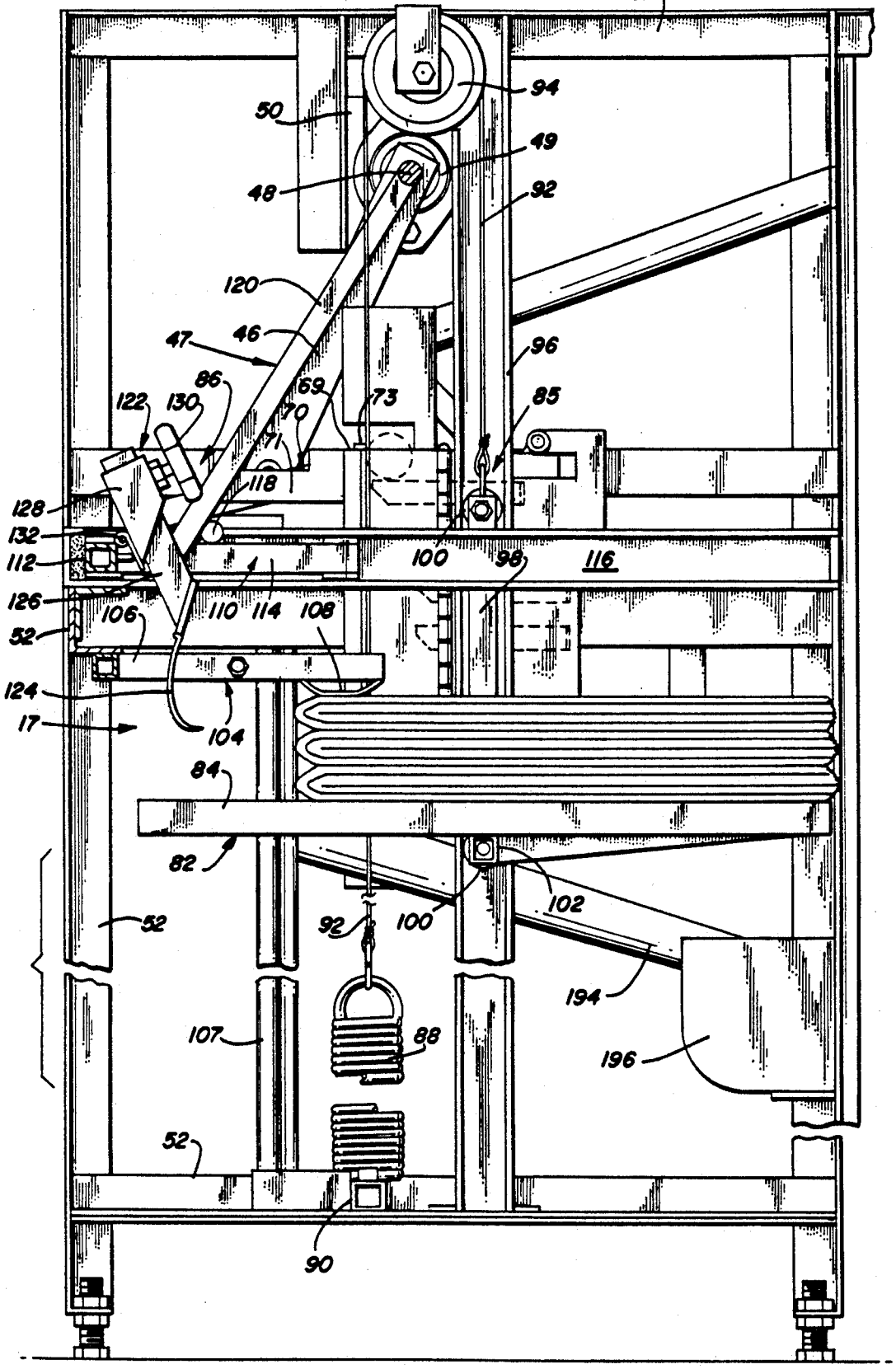
FIG. 7 is an enlarged cross-sectional view taken substantially along line 7—7 of FIG. 6.
Figure 10:
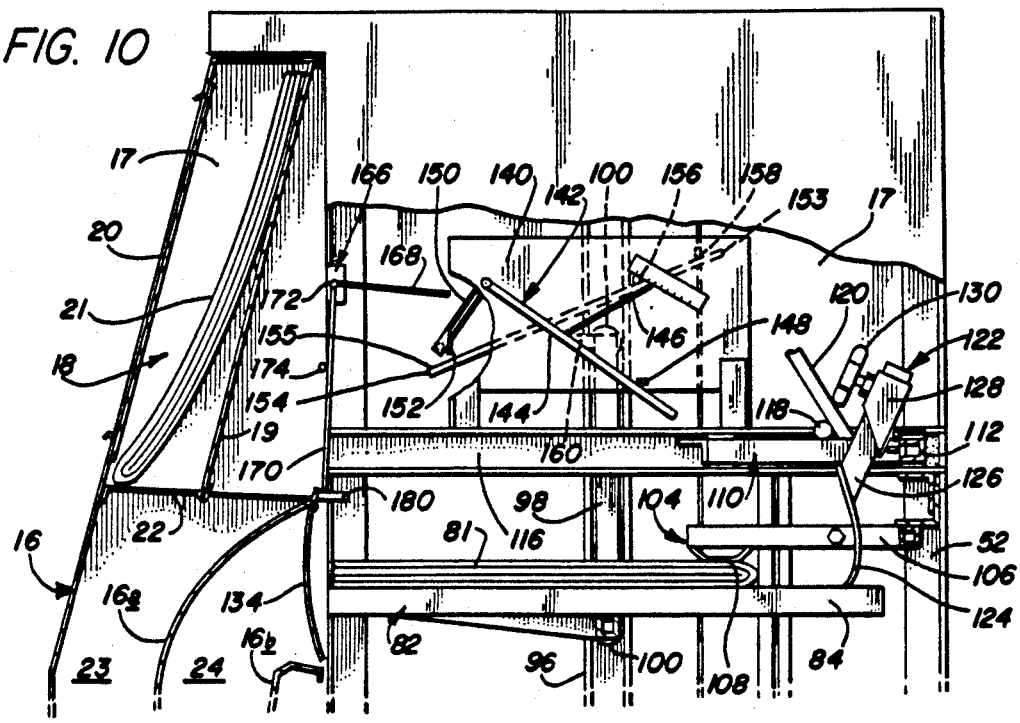
FIG. 10 is a left-side-elevational view of the vending machine with portions thereof broken away showing a final newspaper stored on the shelf.

In FIG. 10, which is looking in the direction as indicated by arrows 10—10 in FIG. 6, there is shown the upper portion of door 16 in section, wherein display compartment 18 is shown having a single newspaper 21 arranged so that the front page can be seen through glass panel 20. The display compartment also indicates the number of newspapers that are not seen but are stored with the internal storage compartment, as has been heretofore described. Means is provided whereby paper 21 will be automatically released when all of the newspapers 80 have been sold and shelf 84 no longer supports any newspapers. The automatic release means for the displayed paper 21 comprises a support partition 140 secured to the main frame 52 at the inner left side of the storage compartment 17. (See FIGS. 6, 10 through 12.) Pivotally mounted to partition 140 is a spring-loaded bell crank 142 which includes an elongated crank arm 144 that is attached to a spring 146, which moves crank arm 144 rearwardly to engage lower stop pin 148.

Figure 11:
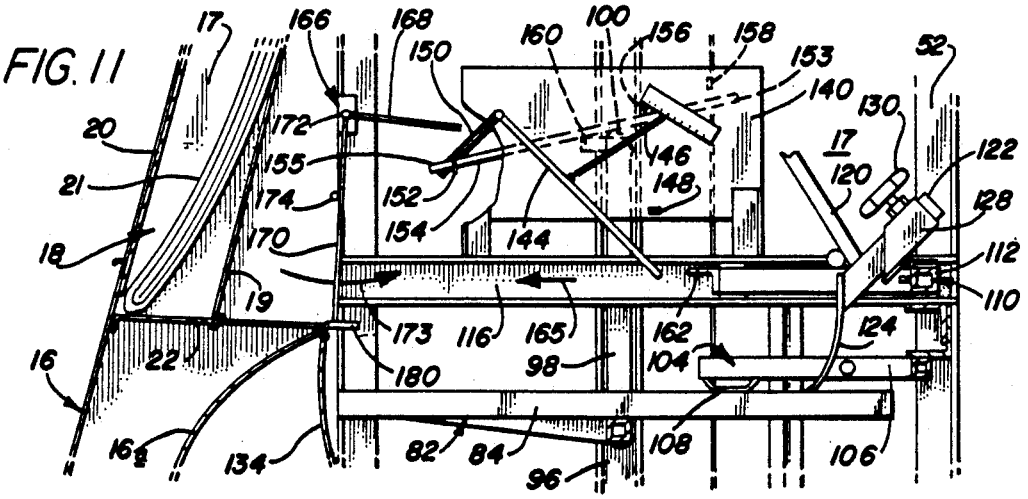
FIG. 11 is a view of the vending machine similar to that of FIG. 10, wherein all of the newspapers in the storage compartment have been removed.

A shorter crank arm 150 of bell crank 142 is located on the opposite side of partition 140 and is held in a downwardly inclined position because of spring 146. Crank arm 150 is formed having a forked end 152 and a side-extended member 151. Forked end 152 is adapted and positioned to receive lever arm 154 which is pivotally mounted to the back side of partition 140 at pivot point 156. An upper stop pin 158 is mounted on partition 140, whereby the upper end 153 of lever 154 will engage stop pin 158 so as to prevent the lower end 155 of lever 154 from dropping out of fork 152. Both crank arm 150 and lower end 155 of lever 154 can move upwardly. In FIG. 10 the last newspaper 81 is still on shelf 84 and is interposed between shelf 84 and foot pad 108, wherein guide bar 98 is also held in a position just below lever 154. The guide bar 98 mounted on the left side of shelf 84 is provided with an extended lug 160 secured to the upper end bar 98 adjacent upper roller 100. When the last paper is removed or discharged and shelf 84 is empty, it will stop against foot pad 108, as illustrated in FIG. 11. As shelf 84 engages foot pad 108, lug 160 will engage and raise lever arm 154 which in turn forces bell crank 142 to move, thereby lifting bell crank arm 150 and lowering crank arm 144 for engagement with a projecting shoulder member 162 which is mounted to the front of paper-dispensing carriage 110.

Figure 12:
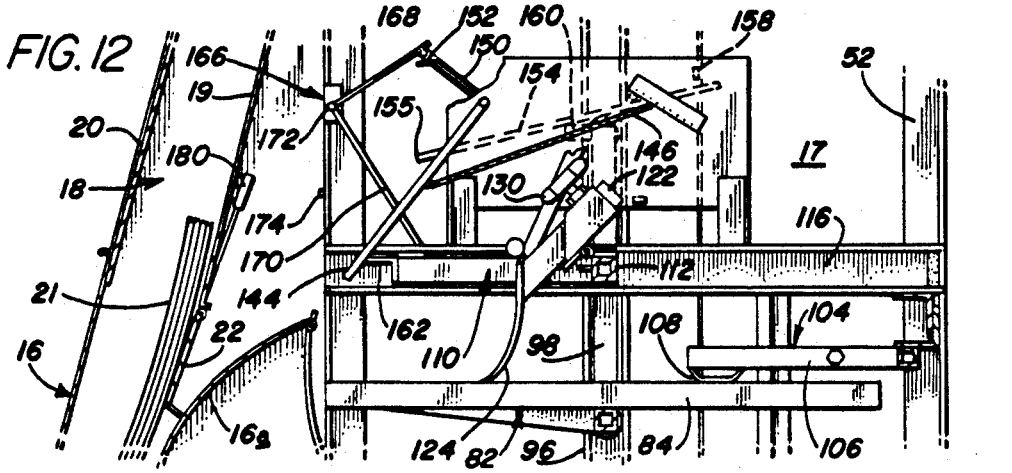
FIG. 12 is a view of the vending machine similar to that of FIG. 11, wherein the final newspaper stored in the display compartment of the door is being discharged.
Figure 13:
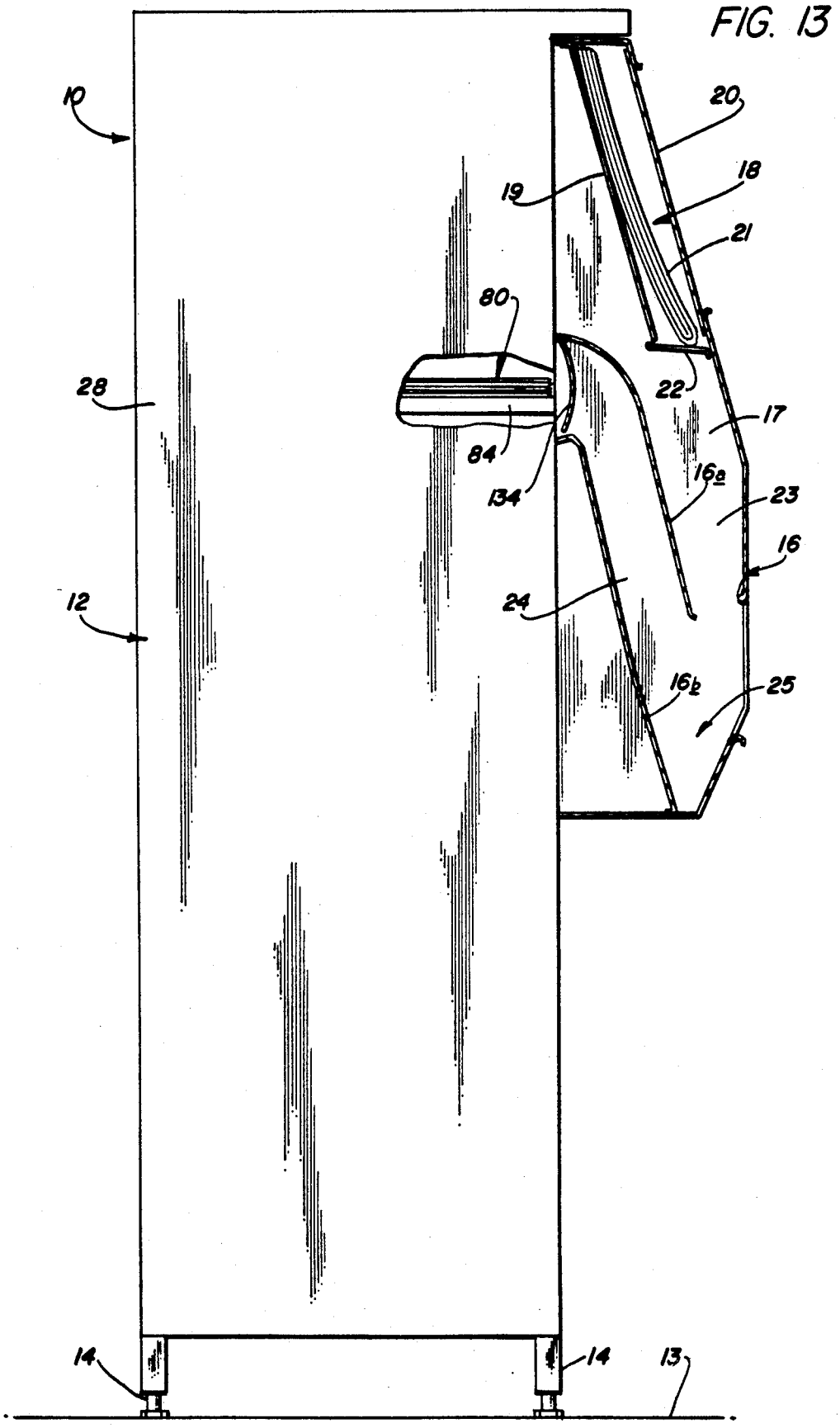
FIG. 13 is a right-side-elevational view with the door of the vending machine in cross section.

When the vending machine is operated after the last newspaper has been dispensed, carriage 110 will move forward in the direction of arrow 165, whereby shoulder member 162 will engage the free end of crank arm 144, as illustrated in FIG. 12. This forces crank arm 144 forward and causes the side-extended member 151 of shorter crank arm 150 to contact a keeper means 166, which is defined by second bell crank that is pivotally attached to the main frame at 172 and it includes a short arm 168 and a long arm 170. Thus, as arm 150 is raised member 151 contacts arm 168 of bell crank 166, as illustrated in FIG. 12, whereby arm 168 is moved upwardly by member 151, causing longer arm 170 to move in the direction of arrow 173 away from stop pin 174. As arm 170 moves in the direction of arrow 173, it frees the paper-support gate 17. The weight of the stored newspaper 21 will open the support gate 17 and drop down through chute 23 into trough 25. It should be note that newspaper-display compartment 18 is defined by the front glass panel 20, oppositely disposed side walls 17, rear wall 19, and the hinged bottom wall that defines newspaper support gate 22, which is hingedly attached along the bottom edge of rear wall 19 and includes a counter-balance member 180.

When newspaper 21 is placed in display compartment 18, the weight of the newspaper will force counter-balance member 180 against the tip end of crank arm 170 or keeper means 166, thereby locking the hinged support gate 22 in a closed mode and preventing paper 21 from dropping out of the display compartment. However, when the display compartment is empty, counter-balance member or weight 180 returns support gate 22 to a horizontally closed mode and is held there by arm 170 of bell crank 166, as seen in FIGS. 10 and 11. After the displayed paper 21 is released and handle 40 returns to its rest position, dispensing carriage 110 will also return to the rear of rail 116.

A coin-return means, generally indicated at 185, is shown in FIGS. 1 and 2, and includes knob 186 attached to a spring-loaded push rod 188 which has an ear member 190 that engages and operates a coin-release means 192. Any suitable coin-release means may be provided to allow coins positioned within coin-operating means 35 to be discharged into return trough 194 that terminates in coin-return box 196.

It may thus be seen that the objects of the present invention set forth herein, as well as those made apparent from the foregoing description, are efficiently attained. While the preferred embodiment of the invention has been set forth for purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What we claim is:

1. A newspaper vending machine comprising:

an enclosed housing having a frame structure defining a newspaper-storage compartment;

a front door mounted to said housing for access to said storage compartment;

a display compartment defined in said front door whereby a single newspaper is stored for display therein;

means for locking said front door for controlled access to said storage compartment;

coin-operated means including coin-receiving means;

actuating means operably connected to said coin-operated means;

newspaper-dispensing means operated by said coin-operated means;

floating support means on which a multiplicity of newspapers are stacked within said storage compartment, whereby the top newspaper of said stacked newspapers is sequentially positioned to be dispensed by said newspaper-dispensing means;

means for releasing said newspaper displayed in said display compartment of said door after all of said stacked newspapers have been dispensed from said floating support means;

newspaper-receiving means formed in said front door to receive a dispensed newspaper; and coin-return means attached to said coin-receiving means;

wherein said newspaper-dispensing means comprises:

a newspaper-dispensing carriage slidably mounted in a carriage-guide means;

actuating means operably connected to said newspaper-dispensing carriage;

newspaper-feeder means attached to said newspaper-dispensing carriage and adjustably mounted to engage the top positioned newspaper, whereby only said top newspaper is readily moved from the top of said stacked newspapers into said receiving means in said front door; and means for adjusting said newspaper-feeder means to engage said top-positioned newspaper; and wherein said actuating means comprises:

a handle mounted to the front of said housing;

a lever arm attached to said handle and extending within said housing, and including a latching arm pivotally mounted thereon, whereby said latching arm prevents said actuating means from operating without the proper coin or coins being inserted within said coin-receiving means;

a carriage plate releasably connected to said lever arm and slidably mounted to a carriage-plate support frame for back-and-forth movement thereon when said lever arm is moved;

means attached to said carriage plate to release said carriage plate from said lever arm as said lever arm is extended outwardly therefrom;

biasing means attached to said lever arm, whereby said arm and said carriage plate are returned to a rearward rest position after said lever arm is pulled forwardly;

coin-activated releasing means pivotally mounted to said carriage plate and positioned thereon for engagement with a coin when positioned in said coin-receiving means and with said latching arm mounted to said lever arm;

engagement means interconnected between said lever arm and said dispensing carriage, whereby the back-and-forth movement of said lever arm is transferred to said newspaper-dispensing carriage.

2. A newspaper vending machine as recited in claim 1, wherein said floating support means comprises:

an vertically adjustable shelf mounted within said storage compartment;

vertical guide means mounted to said shelf, whereby said shelf is guided vertical up and down in a horizontal plane;

a alignment means mounted to said frame structure and said vertical guide means;

automatic positioning means interconnected between said shelf and said frame structure, wherein said newspapers supported on said shelf are raised or lowered, whereby the uppermost newspaper engages said alignment means so as to position the uppermost newspaper in substantial alignment with said newspaper-feeder means as the number and/or weight of said newspapers changes during the operation of said vending machine.

3. A vending machine as recited in claim 2, wherein said automatic positioning means comprises a counter-balancing means.

4. A vending machine as recited in claim 3, wherein said counter-balancing means comprises a pair of spring members positioned on each side of said shelf and attached to the lower portion of said frame structure, wherein each spring member includes an elongated cable attached at one end to said spring member and attached at the opposite end thereof to a guide bar slidably mounted within a vertically disposed track member, wherein each of said guide bars are fixedly secured to respective sides of said shelf, and wherein each of said elongated cables are mounted over a respective pulley attached to the upper portion of said frame structure.

5. A vending machine as recited in claim 4, wherein said alignment means comprises a pair of fixed spaced-apart leg members fixedly secured to said frame structure, wherein each of said leg members includes a foot-pad member mounted adjacent the free end thereof for engagement with the stacked newspapers so as to limit to upward movement of the shelf.

6. A vending machine as recited in claim 5, wherein said newspaper-dispensing carriage comprises:

a rear transverse frame member having oppositely positioned carriage-guide members formed thereon, each of said carriage-guide members being formed having a coupling bracket formed therein; and a pair of horizontally arranged rails positioned to receive the oppositely positioned carriage-guide members, whereby said dispensing carriage is moved back and forth with said engagement means.

7. A vending machine as recited in claim 6, wherein said engagement means includes:

a crank arm connected at one end thereof to said lever arm;

a laterally extended shaft rotatably mounted to said frame structure and attached to one end of said crack arm so as to move back and forth with said lever arm; and a pair of depending engagement arms positioned to be received in said respective coupling brackets of said carriage-guide members.

8. A vending machine as recited in claim 7, wherein said newspaper-feeder means comprises:

an adjustable feeder plate mounted to an extension arm;

a sleeve hingedly secured to said rear transverse frame member of said newspaper-dispensing carriage and formed to slidably receive said extension arm of said feeder plate, wherein said feeder plate is adjustably positioned to engage the top-positioned newspaper on said shelf; and means for adjustably securing said feeder plate in a set position.

9. A vending machine as recited in claim 1, wherein said newspaper-receiving means comprises:

a paper-receiving trough formed in the lower portion of said front door;

a first chute formed in said front door and arranged to communicate between said newspaper-storage compartment at the upper end thereof and said paper-receiving trough at the lower end thereof; and a second chute formed in said front door, wherein the upper end thereof communicates with said display compartment in said door.

10. A vending machine as recited in claim 9, wherein said first chute includes means positioned between said first chute and said newspaper-storage compartment to prevent access to newspapers stored in said newspaper-storage compartment.

11. A vending machine as recited in claim 2, wherein said newspaper-receiving means comprises:

a paper-receiving trough formed in the lower portion of said front door;

a first chute formed in said front door and arranged to communicate between said newspaper-storage compartment at the upper end thereof and said paper-receiving trough at the lower end thereof;

a second chute formed in said front door, wherein the upper end thereof communicates with said display compartment in said door; and means positioned between said first chute and said newspaper-storage compartment to prevent access to newspapers stored in said newspaper-storage compartment.

12. A vending machine as recited in claim 11, wherein said newspaper-display compartment is defined by a front glass panel, a pair of oppositely disposed side walls, a rear wall, and a support gate hingedly attached along the bottom edge of said rear wall.

13. A vending machine as recited in claim 12, wherein said support gate is operably connected to a gate-release means which is activated by said newspaper-dispensing carriage after all of said stacked newspapers have been dispensed from said newspaper-storage compartment.

* * * * *